US005764273A

United States Patent [19]

Paoli

[11] Patent Number: 5,764,273

[45] **Date of Patent: *Jun. 9, 1998**

[54] SPOT POSITION CONTROL USING A LINEAR ARRAY OF LIGHT VALVES

[75] Inventor: Thomas L. Paoli, Los Altos, Calif.

[73] Assignee: Xerox Corporation, Stamford, Conn.

[ * ] Notice: The term of this patent shall not extend beyond the expiration date of Pat. No. 5,574,491.

[21] Appl. No.: 574,566

[22] Filed: Dec. 14, 1995

Related U.S. Application Data

[63] Continuation of Ser. No. 113,463, Aug. 27, 1993, abandoned.

[51] Int. Cl.[6] ..... B41J 2/435

[52] U.S. Cl. ..... 347/248; 347/234

[58] Field of Search ..... 347/248, 234, 347/250, 239, 136; 372/24; 359/204; 250/578.1

[56] References Cited

U.S. PATENT DOCUMENTS

| | | | |
|---|---|---|---|
| 4,040,096 | 8/1977 | Starkweather | 358/302 |
| 4,281,904 | 8/1981 | Sprague et al. | 359/263 |
| 4,445,125 | 4/1984 | Scifres et al. | 247/237 |
| 4,536,778 | 8/1985 | De Schamphelaere et al. | 347/130 |
| 4,600,837 | 7/1986 | DeStefano et al. | 250/235 |
| 4,651,169 | 3/1987 | Muka | 347/261 |
| 4,651,170 | 3/1987 | Chandler et al. | 347/259 |
| 4,802,182 | 1/1989 | Thornton et al. | 372/50 |
| 4,845,725 | 7/1989 | Welch et al. | 372/46 |
| 4,864,326 | 9/1989 | Kawamura et al. | 347/240 |
| 4,870,652 | 9/1989 | Thornton | 372/50 |
| 4,925,276 | 5/1990 | McMurray et al. | 359/67 |
| 5,047,789 | 9/1991 | Konayama et al. | 347/232 |
| 5,049,897 | 9/1991 | Ng . | |
| 5,138,339 | 8/1992 | Curry et al. | 347/239 X |
| 5,574,491 | 11/1996 | Paoli | 347/248 |

FOREIGN PATENT DOCUMENTS 22 20018 9/1990 Japan .

OTHER PUBLICATIONS

Bestenreiner, F.; Greis, U.; Helmberger, J.; and Stadler, K., "Visibility and Correction of Periodic Interference Structures in Line-by-Line Recorded Images," Journal of Applied Photographic Engineering, 2:2, Spring 1976, pp. 86–92.

Filinski, I. and Skettrup, T., "Fast Dispersive Beam Deflectors and Modulators," IEEE Journal of Quantum Electronics, QE-18:7, Jul. 1982, pp. 1059–1062.

Sprague, R. A.; Urbach, J. C.; and Fisli, T. S., "Advances in Laser and E-O Printing Technology," Laser Focus/Electro-Optics, Oct. 1983, pp. 101–109.

Thornton, R. L.; Burnham, R. D.; and Paoli, T. L., "Low Threshold Planar Buried Heterostructure Lasers Fabricated by Impurity-Induced Disordering," App. Phys. Lett., vol. Y7, No. 12, 1986, pp. 1239–1241.

Urbach, J. C.; Fisli, T. S.; and Starkweather, G. K., "Laser Scanning for Electronic Printing," Proceedings of the IEEE, 70:6, Jun. 1982, pp. 597–618.

*Primary Examiner*—David F. Yockey

[57] ABSTRACT

A method and apparatus for using a raster output scanner which includes an array of independently addressable light valve elements that control the slow scan direction position of a spot in an image plane. In operation, the array is illuminated by light from a separate optical source and disposed such that the spot from each element of the array impinges the image plane in a different position in the slow scan direction and such that the maximum distance between the spots is less than the distance between scan lines. Only a single element of the array passes light per scan line, thus only a single spot is formed on the image plane per scan line. Control of which element in the array transmits a light beam per scan line allows control of the spot position in the slow scan direction for that scan line.

13 Claims, 8 Drawing Sheets

SPOT POSITION CONTROL USING A LINEAR ARRAY OF LIGHT VALVES

This is a continuation, of application Ser. No. 08/113, 463, filed Aug. 27, 1993 abandoned.

This invention relates to optical raster output scanning systems that control the slow scan direction position of a spot on a photoreceptor.

BACKGROUND OF THE INVENTION

For many reasons, Raster Output Scanning (ROS) has become the predominant method for sweeping spots of light across a photoreceptor. When using a ROS, spot sweeping is accomplished by impinging one or more light beams onto a rotating mirror; that mirror usually being a facet of a multifaceted polygon. The reflected light is directed onto a photoreceptor. As the mirror rotates, the spot produced by the light beam on the photoreceptor sweeps across the photoreceptor.

While ROSs are used in many applications, probably their most common use is in digital printing. Thus, the following describes the use of ROSs in digital printing. However, the problem of spot position control, the subject of the present invention, occurs in other ROS applications. Therefore, the scope of the present invention is defined by the claims.

In digital printing the direction that the spot sweeps because of the rotation of the mirror will be referred to as the fast scan direction. As a spot sweeps, the photosensor moves (relatively) in a direction orthogonal to the fast scan direction. That direction will be referred to as the slow scan direction. By moving the spot relative to the photoreceptor in both the fast scan and slow scan directions, the spot raster scans the photoreceptor. To transfer image information to the photoreceptor, the intensity of the light beam (and thus the resulting spot) is modulated by image data synchronized with the movement of the spot across the photoreceptor. Thus, individual picture elements ("pixels") of the image are created on the photoreceptor in the form of a latent image, which may then be transferred to an appropriate medium, such as sheet paper.

Implementations of the process described above are not perfect. One set of problems relate to spot position errors in the slow scan direction. Consider that typical digital printers usually image at least 300 lines per inch. It has been shown that spot position errors in the slow scan direction of more than 10% of the nominal line spacing are noticeable in a half tone or continuous tone image. Spot position errors in ROS color printers or in high resolution printing (say more than about 600 spots per inch) are even more noticeable.

Slow scan spot position errors arise from many sources, including polygon and/or photosensor motion flaws and facet and/or photosensor surface defects. Such errors may be addressed by the use of passive or active in-line optics or, if the positional error extends over an entire scan line, by retarding or advancing the start of a scan. (this correction is limited to whole multiples of a scan line spacing). See, for example, *Advances in Laser and E-O Printing Technology*, Sprague et al., Laser Focus/Electro-Optics, pp. 101–109, October 1983. Another approach is the use extremely high quality, but costly, optical and mechanical elements. Other approaches are also possible. See, for example, U.S. Pat. No. 4,040,096, issued Aug. 2, 1977 to Starkweather; the closed loop acousto-optical (A–O) compensation system discussed in *Laser Scanning for Electronic Printing* Urbach et al., Proceedings of the IEEE, vol. 70, No. 6, June 1982, page 612: the teachings in *Visibility and Correction of Periodic Interference Structures In Line-by-Line Recorded Images*, J. Appl. Phot. Eng., vol. 2, pp. 86–92, Spring 1976; and the approaches in U.S. Pat. Nos. 5,049,897, 5,208,456, 5,204, 523, and No.5,212,381.

However, the prior art schemes to control the slow scan spot positions are rather complex, costly and/or difficult to implement. Thus, a need exists for an improved method of providing very high resolution slow scan direction spot position control.

SUMMARY OF THE INVENTION

The present invention provides for a slow scan direction spot position control system. In the following, spot position refers to the location where a light beam strikes an image plane, while spot registration refers to the correspondence of a spot's position relative to other spot positions (for example in overwriting a spot to accent tone, position, or color). However, for simplicity, any reference to the control of spot position will include control of spot registration, unless otherwise noted. Spot position control is achieved using a linear array of closely spaced light valve elements to emulate a linear array of individually addressable lasers. By activating only one of the light valve elements during the scan of a line and by controlling which light valve is activated, spot position control is achieved.

One embodiment of the present invention is a raster output scanning apparatus which includes, inter alia, a light source composed of a single laser beam illuminating a linear array of closely spaced and individually addressed light valve elements, some means for selecting one of the light valve elements, some means for modulating the generated laser beam in accordance with a data signal, some means for scanning the transmitted portion of the light beam in a raster fashion, and a photoreceptor. Examples of light valve elements include liquid crystal modulators, reflecting Fabry-Perot modulators, total internal reflective modulators, or a waveguided modulator/amplifier. Examples of photoreceptors include a photosensitive drum or belt, a display screen or photographic film. A particular application may also include some means for determining the existence and extent of spot position errors and/or the need to apply predetermined spot position correction.

In operation, a modulated light beam is generated by the laser source, with the modulation dependent upon image data. The modulated light beam illuminates the linear array of light valve elements. One of the elements is caused to transmit the modulated light beam, while all of the others block the light beam. The transmitted light beam illuminates a facet of a rotating polygon, which causes the beam to sweep across at least a portion of a photoreceptor in a fast scan direction. Relative motion in the slow scan direction between the spot and the photoreceptor causes the spot to scan across at least a portion of the photoreceptor in the slow scan direction. The existence and extent of error, if any, in the position of the spot in the slow scan direction is determined and used to select the light valve element that causes the error to be minimized.

The present invention may be employed to correct for inter-line slow scan direction positional errors in response to the output of some active error detecting means or in response to predetermined correction information. Further, the present invention may be implemented in a system wherein the maximum slow scan direction spot position correction is one half of a scan line spacing. In such a system any greater correction may be realized through a combination of spot position control and retardation or advancement of one or more scan lines.

BRIEF DESCRIPTION OF THE DRAWINGS

In general, like reference numerals denote like elements as between each of the aforementioned figures.

DETAILED DESCRIPTION

Figure 1:
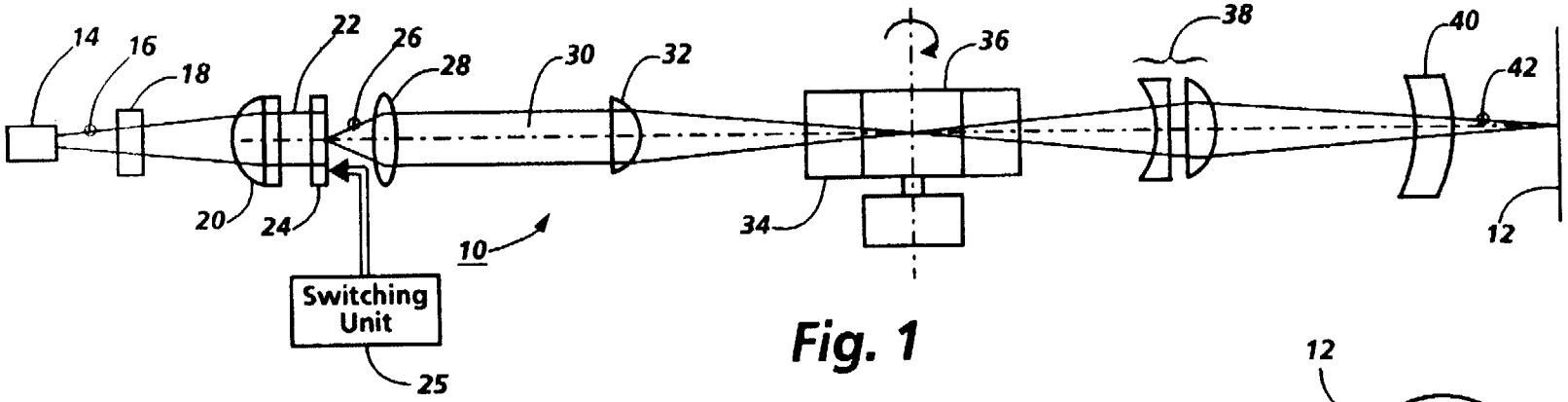
FIG. 1 shows a side view of the optical configuration of an apparatus according to one embodiment of the present invention.
Figure 1A:
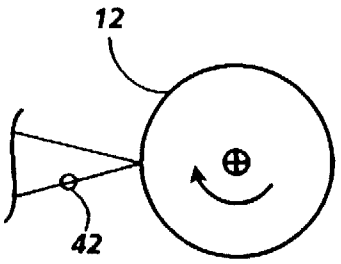
FIG. 1A shows a photoreceptive drum at the image plane of the apparatus of FIG. 1.
Figure 2:
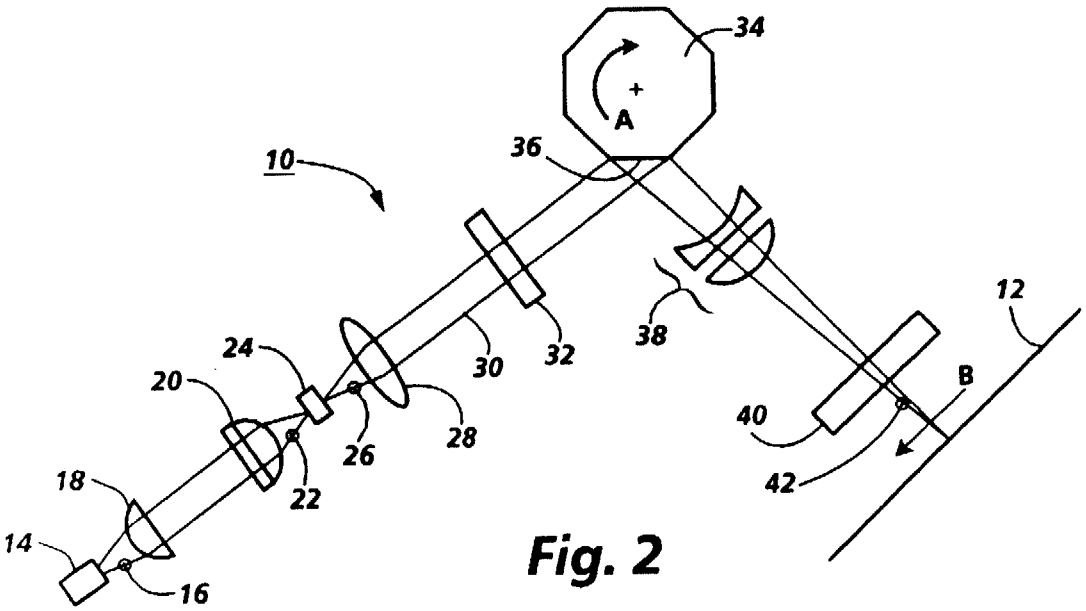
FIG. 2 shows a top view of the optical configuration of the apparatus of FIG. 1.

A detailed description of a first embodiment of the present invention is presented with reference to FIGS. 1, 1A, and 2. Those figures show various views of the slow scan plane (FIGS. 1 and 1A) and the fast scan plane (FIG. 2) of the operation of a scanning apparatus 10. The apparatus 10 outputs a swept, modulated optical signal onto a photoreceptor 12 (which in the first embodiment is a photoreceptive drum).

The apparatus 10 has a light source 14 (see below) which produces a beam of light 16 that passes from the laser into a cylindrical lens 18 which collimates the beam 16 in the fast scan plane. Light from the cylindrical lens 18 is input to a toric lens 20. The toric lens 20 is comprised of a front surface having power only in the slow scan direction, and a back surface that focuses the light into a beam 22 and onto a light valve array 24 having N elements. Operation of the light valve array is controlled by a switching unit 25.

The light beam 22 applied to the light valve array 24 is passed by only one of the light valves as light beam 26 (as controlled by the switching unit 25) to a spherical lens 28. The spherical lens produces a collimated light beam 30 which passes through a cylindrical lens 32 that has power only in the slow scan plane. Light from the cylindrical lens 32 illuminates a rotating polygon 34 having at least one reflective facet 36. The facet reflects the illuminating light into a compound spherical lens 38, and from there into a toroidal lens 40. The light 42 from the toroidal lens 40 produces a spot on the photoreceptor 12. The lenses 38 and 40 not only focus the light beam 42 to produce a circular (or elliptical) spot on the photoreceptor 12, but they also correct for scan nonlinearity (f-theta correction) and for wobble (scanner motion or facet errors).

As the polygon 34 rotates in a clockwise fashion (see FIG. 2), the spot that results from the light beam 42 sweeps across the photoreceptor in the fast scan direction as indicated by the arrow. Additionally, by turning the photoreceptor 12 (see FIG. 1A), the spot sweeps across the photoreceptor in the slow scan direction. Then, by modulating (per image information) the current applied to the laser source 14 in synchronism with the motion of the polygon 34 and the photoreceptor 12, the light beam 42 produces a latent image on the photoreceptor that can be used to produce a permanent image.

Of course, the embodiment shown in FIGS. 1, 1A, and 2 is only one of a large number of other configurations for practicing the present invention. Furthermore, many of the details of the lenses and other optical, mechanical, and electrical components of a complete ROS system are omitted for clarity since they are well known in the art.

Spot position control in the first embodiment is via the array 24. Each light valve element in the array is capable of transmitting or blocking light in response to an applied electrical signal. Although there are N light valve elements in the array, only one transmits light during each fast scan sweep. The application of a suitable bias to each light valve element is accomplished prior to each scan by a switching unit as described below.

Figure 3:
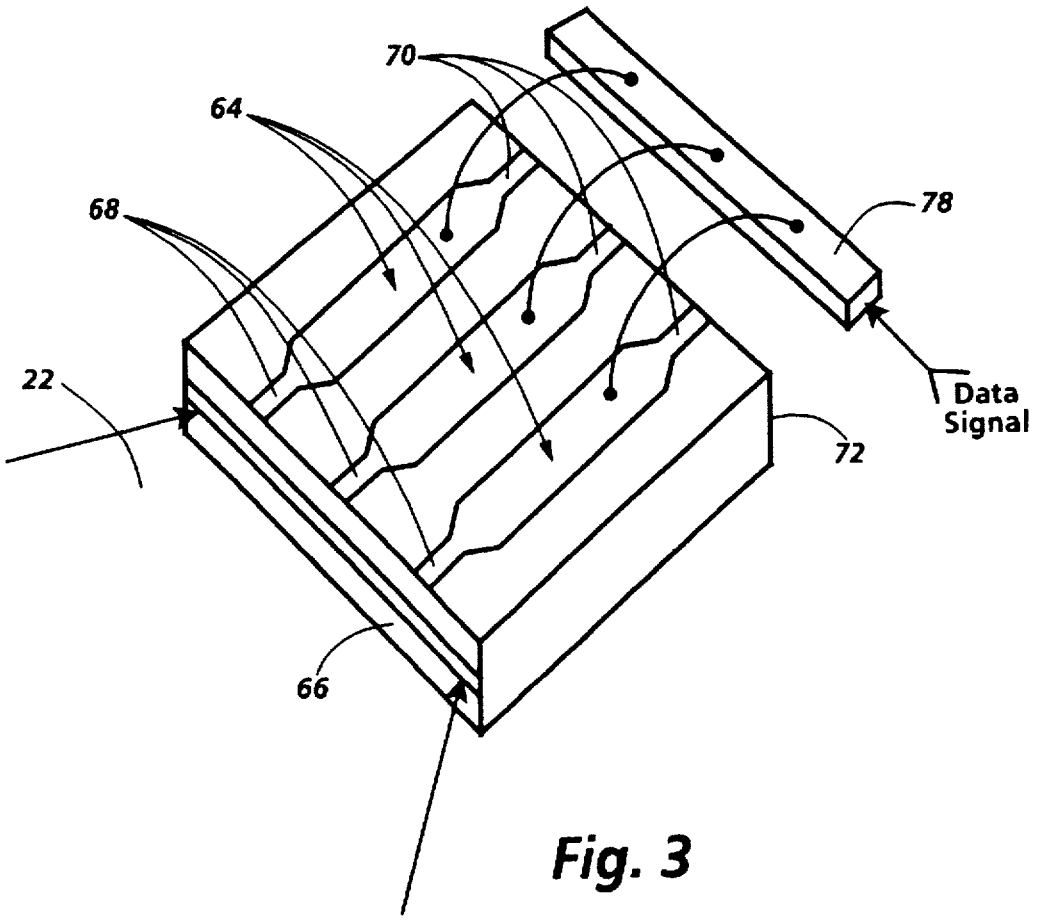
FIG. 3 shows one embodiment of an array of closely spaced light valves capable of transmitting incident light through one of a number of selectable elements.

While many different types of light valve arrays are possible, the light valve array 24 is comprised of an array of active waveguides 60 as shown in FIG. 3, and as disclosed in U.S. Pat. No. 5,305,412 which is hereby incorporated by reference. The active waveguide array 60 has a plurality of semiconductor waveguides 64 that are capable of transmitting or blocking incident light. The incident light is coupled into the semiconductor waveguides at facet 66 via passive waveguides 68. Transmitted light is emitted through passive waveguides 70 at facet end 72. The active waveguide array 60 is made from a semiconductor heterostructure containing p-n junctions as described in Patent Application D/88221. The individual semiconductor waveguides 64 block the passage of incident light when their p-n junctions are reverse biased, and pass incident light when their p-n junctions are forward-biased. The biases on the various p-n junctions are controlled by a switching unit 25 in response to a selection signal (see below).

Alternatively, the light valve array 24 may be comprised of N linearly arranged, closely spaced total internal reflection (TIR) modulators (see, for example, U.S. Pat. No. 4,281,904). A TIR light valve is comprised of a crystal bar of electro-optical material having an array of interdigital electrodes deposited on one of its major surfaces. By applying a voltage to an electrode, an electric field is created in the bulk crystal which changes the phase front of the light beam, thereby either blocking or transmitting a portion of the incident light beam. Each of the electrodes may be individually addressed by an independent electrical signal thereby allowing selection of one transmitting element while maintaining all other elements in the blocking state.

Alternatively, the light valve array 24 may be comprised of N linearly arranged, closely spaced light valve elements made from a liquid crystal material.

Figure 4:
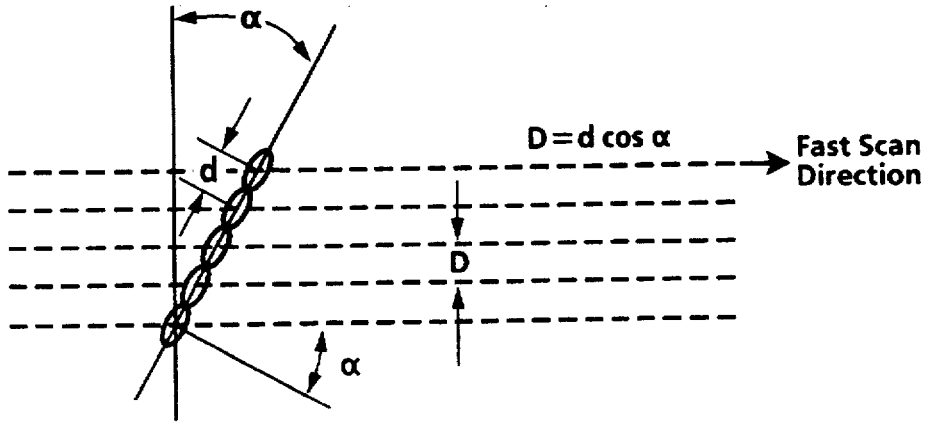
FIG. 4 shows a schematic representation of spots imaged on the photoreceptor during a single scan.

While it is possible to space light valves fairly close together, to achieve very close spot position control, the light valve array should be inclined by an angle $\alpha$ with respect to the slow scan direction, see FIG. 4.

Light input to the light valve array should be at an optical power level such that the portion transmitted by one light valve element is sufficient to properly expose the photoreceptor 12. As a result of this requirement, the light source 14 is beneficially an incoherent array of diode lasers (such as those disclosed in U.S. Pat. No 4,786,918). Such an incoherent light source is beneficially comprised of a plurality of laser elements which are closely spaced, but optically uncoupled so that no optical coherence exists between them. As a result of the close spacing without optical coherence, the radiation pattern of the entire array corresponds to the radiation pattern of the individual laser emitters. Alternatively, the light beam from a single laser emitter can be used provided the total output power is sufficient.

The overall range E of spot position control is determined by the number N of light valves in the array and the effective distance D (see FIG. 4) between the scans produced by each light valve on the photoreceptive surface by the same facet of the scanning polygon as $$E=DN. \quad (1)$$

The range E is determined by the line spacing of the raster scanning, while the effective distance D is set by the desired quality of the printing. The range E over which the spot must be placed is at most ± one half of the line spacing. Any greater correction may be realized through a combination of this amount of control and retardation or advancement of one or more scan lines. The effective distance D is determined by the accuracy A of spot position placement required by the desired quality of the printing, since D is the minimum distance that the scan line can be shifted by moving from one light valve to its adjacent neighbor in the array. As shown in FIG. 4:

$$D=d \cos \alpha \quad (2)$$

where d is the distance between light valves in the array and $\alpha$ is the angle of inclination between the array and the slow scan direction. Thus the number of light valves in the array is equal to the line spacing divided by the accuracy. In other words, 1/N is the achievable placement accuracy expressed as a fraction of the line spacing.

For example, a system printing at 300 lines/inch in the slow scan direction requires spot control over a range of at most ±42.33 μm, which is ± one half of the line spacing. Any greater correction may be realized through a combination of this amount of control and retardation or advancement of one or more scan lines. In other words, correction need only be made for the position of scan lines that randomly fall somewhere within ±42.33 μm of the desired position for a 300 lines/inch printer. A placement accuracy of 10% of the line spacing requires a printing system wherein registration error is no more than ±4.23 μm. To achieve this degree of spot control requires 42.33 μm/4.23 μm=10 light valves in the array with element-to-element spacing of 8.47 μm/cos $\alpha$. If $\alpha$=0°, the light valves must be on 8.47 μm centers which is straightforward to achieve with waveguided light valves made by impurity induced disordering as described in U.S. Patent Application D/88221, or other known techniques. If the required position accuracy is ±1.25 μm, E=±42.33 μm requires 34 light valves spaced by 2.5 μm/cos $\alpha$a. If=0°, the light valves must be on 2.5 μm centers which approaches the limit of presently known fabrication techniques. The required element-to-element spacing can be increased to 5.0 μm by inclining the array by angle $\alpha$=60°, determined by cos $\alpha$=2.5 μm /5.0 μm or to 10 μm by inclining the array by 75.5°. The accuracy can be increased further to 1% of the line spacing by inclining an array of 100 light valves with 5.0 μm spacing by $\alpha$=80.3°.

Figure 5:
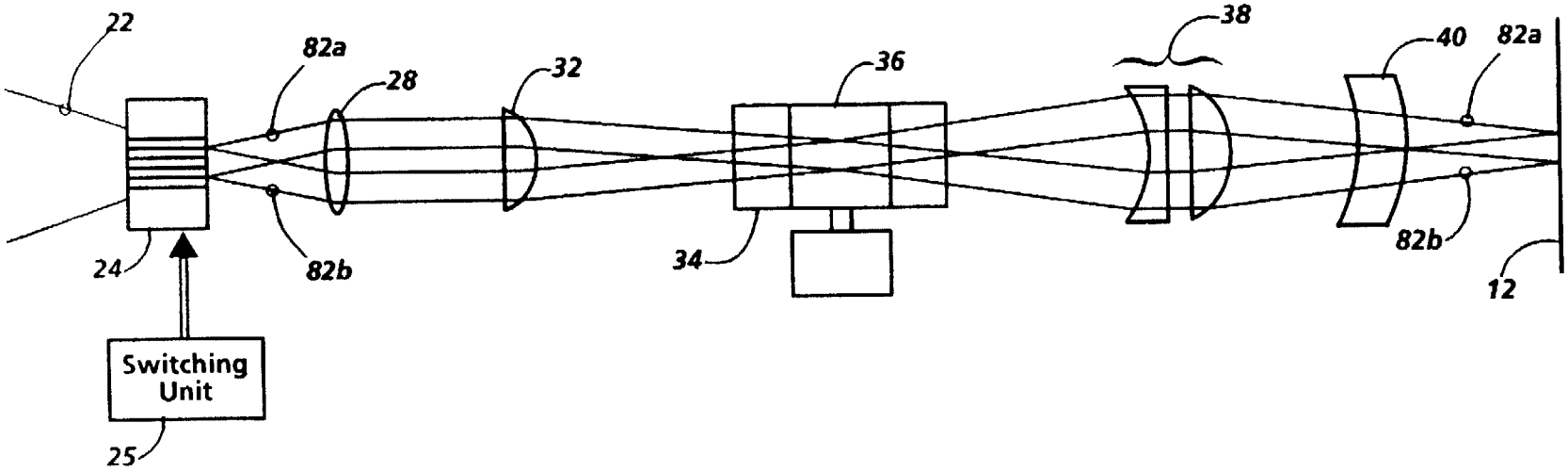
FIG. 5 illustrates the difference in spot positions when different light valve elements are selected.

A requirement of the first embodiment is that the overall magnification of the ROS optics is one (unity), so that the effective spacing between imaged spots is not increased at the photoreceptor surface. Since digital printers may require the spot size to be larger than the spot emitted by each light valve, the spot size in the slow-scan direction must be enlarged independently of the optical magnification. One way to achieve this enlargement is to use the f-number of lens 38 in the ROS to control the spot size in the slow scan direction as well as in the fast scan direction. In this case, the minimum spot size of the diffraction limited lens is 1.06 $\lambda$F, where F is the f-number of the lens and $\lambda$ is the wavelength of the light. It should be noted that although the imaging optics can not resolve the separation between light valves in the array, the center of the imaged spot on the photoreceptor will nevertheless move in the slow-scan direction by the effective element-to-element spacing when the array 60 is switched from one light valve element to an adjacent neighbor. The difference in spot position in the first embodiment when different light valves are selected is illustrated in FIG. 5. In FIG. 5, beams 82*a* and 82*b* are transmitted (at different times) by the light valve array 24. As indicated, when different light valve elements are selected, the position of the spot on photoreceptor 12' changes.

Figure 6:
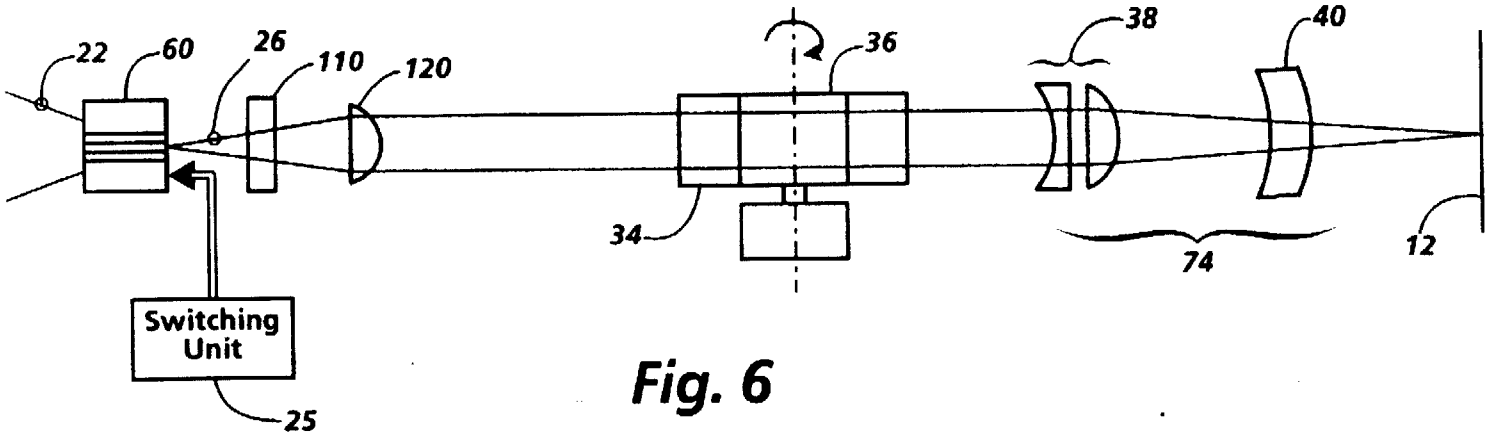
FIG. 6 shows a side view of the optical configuration of an apparatus according to a second embodiment of the present invention.
Figure 7:
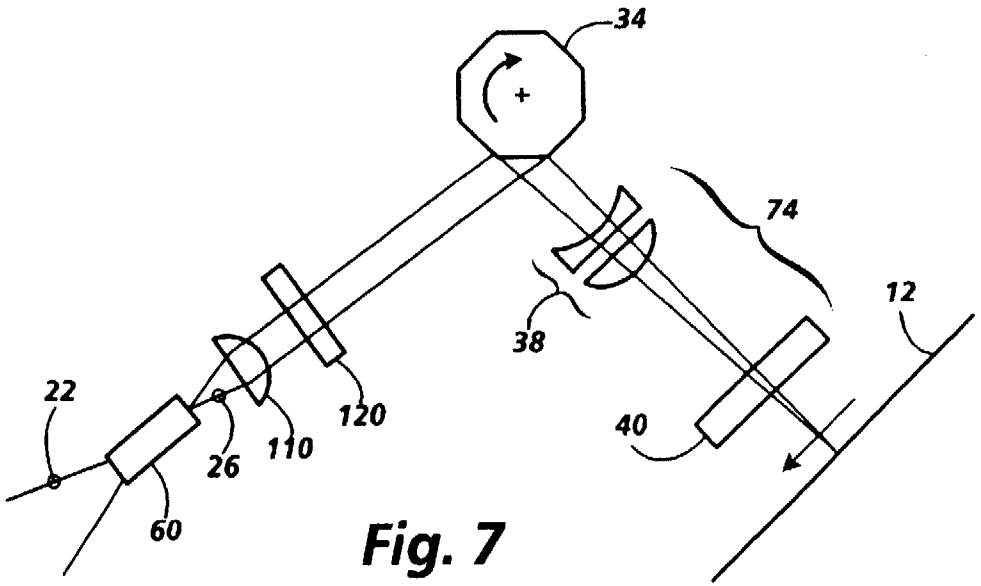
FIG. 7 shows a top view of the optical configuration of the apparatus of FIG. 6.

FIGS. 6 and 7 show another embodiment of the present invention wherein the f-number of the post-polygon optics enlarges the spot size in both the slow-scan and fast-scan directions. In this embodiment, a first cylindrical lens 110 collimates the light beam 26 in the fast scan direction while a second cylindrical lens 120 collimates the light beam 26 in the slow-scan direction. The focal lengths and positions of the cylindrical lenses 110 and 120 are chosen such that the aperture of the post-polygon optics is filled appropriately to produce a focused spot of a size determined by the f-number of the post-polygon optics.

Another embodiment of the present invention uses the pre-polygon optics to magnify both the effective element-to-element spacing in the light valve array and the spot size in the slow-scan direction. This approach requires ROS optics capable of forming a magnified image of the slow-scan spot emitted by each light valve in the array. For this embodiment, the ROS optics is similar to that in FIGS. 1 and 2, wherein the lenses 28 and 32 provided the required degree of magnification in the slow scan direction. As an example, consider a printing system wherein the optical intensity profiles used to scan adjacent lines must overlap such that the full width at half maximum (FWHM) of the intensity profile of each spot is equal to the spacing between lines.

From equation (2), D=d cos $\alpha$. If D is defined as the "accuracy," the "fractional accuracy" of the spot position control, K, can be written as:

$$K=\text{accuracy/line spacing}=[M\ (d \cos \alpha)]/[(M)\ (2S)]=[d \cos \alpha]/(2S), \quad (3)$$

where M is the optical magnification in the slow scan direction and 2S is the spot size emitted by the light valve element in the slow scan direction. The ratio of accuracy to line spacing is independent of the optical magnification in the slow-scan direction because both the effective distance and the spot size are simultaneously magnified by the optics. In the fast scan direction the spot size can be determined by the size of the polygon facet or by the f-number of the post-polygon optics in the fast-scan direction.

Figure 8:
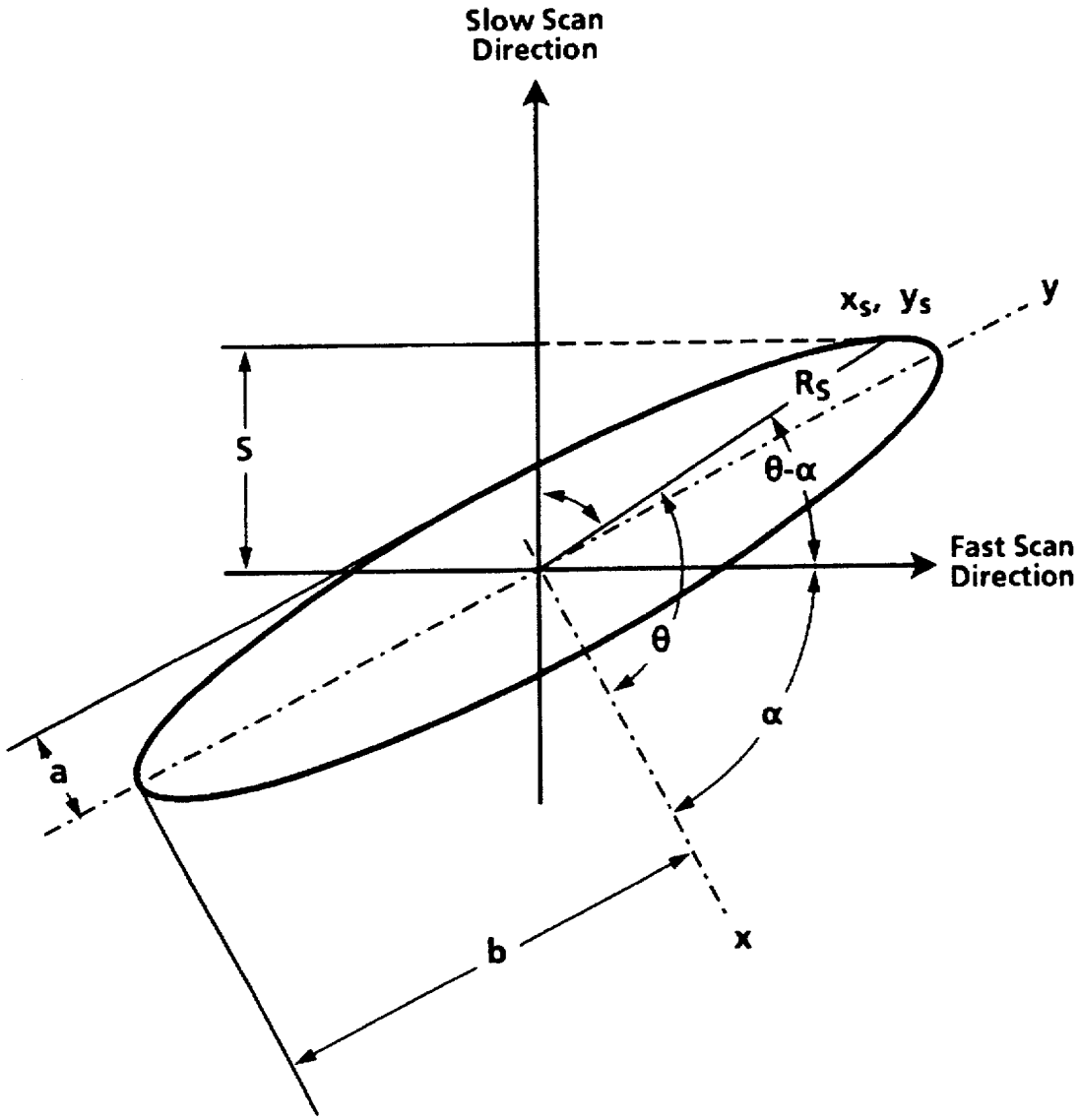
FIG. 8 shows the contours of the intensity distribution at half maximum value for one spot at the light valve's emitting plane.

When the light valve array 24 is inclined to the fast-scan direction as shown in FIG. 4, the effective spot size in the slow scan direction is modified due to rotation of the elliptical intensity distribution emitted by each light valve. For example, FIG. 8 illustrates the elliptical contour of the FWHM of the intensity profile emitted at the output facet of the light valve array with major axis=2b and minor axis =2a rotated by angle α with respect to a line in the fast-scan direction. The effective spot size in the slow-scan direction 2S is given by:

$$2S=2y_s \cos \alpha+2x_s \sin \alpha \quad (4)$$

where $(x_s, y_s)$ are the coordinates of the point on the ellipse which defines S. The point $(x_s, y_s)$ is determined from:

$$x_s^2=a^2/[1+(b/a)^2 cot^2\alpha] \quad (5)$$

and $$y_s^2=b^2/[1+(a/b)^2 \tan^2 \alpha] \quad (6)$$

Waveguided light valve arrays of the buried heterostructure type as disclosed in U.S. patent application D/88221, are typically designed to provide nearly complete confinement of the guided lightwave to the active waveguide. Consequently, the minor axis (2a in FIG. 8) of the FWHM ellipse is normally 1 to 2 μm, while the major axis of the FWHM ellipse (2b in FIG. 8) is normally 2 to 3 μm. The width of the minor axis is determined by the waveguiding layers of the epitaxial layer structure while the width of the major axis is determined (as in a laser structure) by the lateral fabrication process, e.g see, R. L. Thornton, et al., "Low Threshold Planar Buried Heterostructure Lasers Fabricated By Impurity-Induced Disordering", *App. Phys. Lett.*, vol. 47, no. 12, page 1239–1241, (1986). Normally b is wider than a, but in some embodiments, e.g. a TIR light valve or one fabricated in liquid crystal material, b can equal a.

Figure 9:
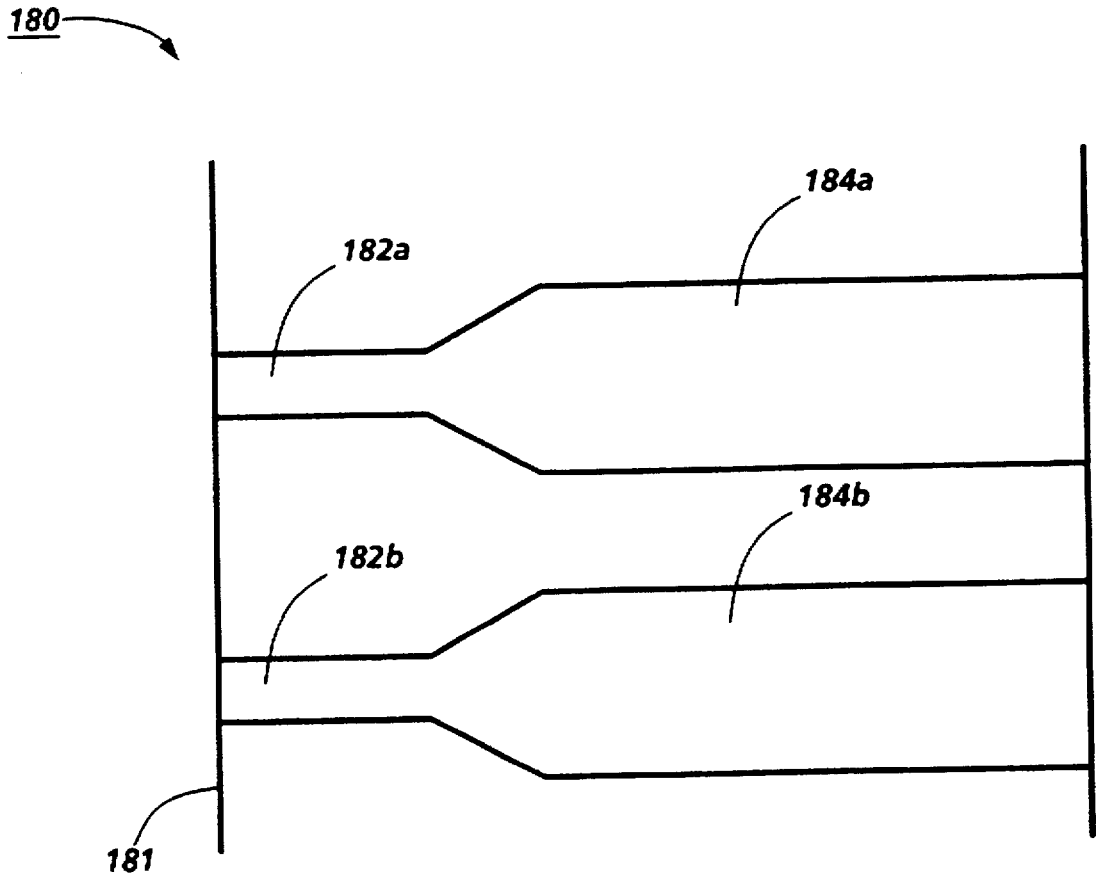
FIG. 9 shows the top view of one embodiment of a waveguided light valve array that is used to obtain a wide spot along the active layer of the light valve structure.

To satisfy all the requirements of the optical system of a printer, it is useful to have an array of light valve elements with values of a and b selected for the system. For a light valve design using waveguided light valves, increasing the thickness or width of the the light valve's active region leads to transmission of unwanted spatial modes. Thus, it is another aim of this invention to provide a waveguided light valve array structure which allows the major and/or minor axes of the FWHM intensity profile of each transmitted beam to be selected independently of the spacing between individual light valve elements in the array for use in the printing apparatus of this invention. Referring to FIG. 9, this goal is accomplished in an array structure 180. In the structure 180, the output light beam is emitted from a light valve facet 181 through narrow output waveguides **182*a* and 182*b*, which are transparent to the light transmitted through active regions 184*a* and 184*b*. The width of the output waveguides 182*a* and 182*b* is less than the critical width required for complete confinement of the transmitted light. Consequently, by decreasing the width of each output waveguide, the output beamwidth 2*b*** of each laser is increased independently of the light valve-to-light valve spacing to a value appropriate for the printing system. Output waveguides of this type may be of the type shown in U.S. Pat. No. 4,802,182 which is incorporated herein by reference. To some extent, a similar widening of the beam size can be accomplished for the minor axis of the FWHM ellipse by partially disordering the active region near the mirror as described in U.S. Pat. No. 4,845,725, which is also incorporated herein by reference.

Examples of suitable combinations of emitted spot size, light valve-to-light valve spacing, and optical magnification in high resolution printing systems are given in Tables I and II for a positioning accuracy of 10% of the line spacing, i.e. K=0.1. The inclination angle α is, in general, determined by inclining the array to satisfy equation (3) for each value of light valve spacing d, i.e. cos α=2S/10d. For the limiting case of a circular emitted spot where a=b, the effective spot size 2S is equal to **2*b*** independent of the angle of inclination. Consequently, the angle of inclination is set by d. The optical magnification required in the slow-scan direction, given by line spacing divided by 2S, is also independent of the angle of inclination. Suitable combinations of the line spacing, light valve spacing, inclination angle, and optical magnification are illustrated in Table I for a ROS employing a circular beam from each light valve element.

TABLE I

| Line Density/ Line Spacing | d | α for position control = 0.1 line spacing | 2b (2a = 2 μm) | Effective slow-scan spot size on valve = 25 | Optical mag in slow-scan direction |
|---|---|---|---|---|---|
| 300 lpi/84.7 μm | 3 μm | 86.18 | 2 μm | 2 μm | 42.4 |
| | 4 μm | 87.13 | 2 μm | 2 μm | 42.4 |
| | 5 μm | 87.71 | 2 μm | 2 μm | 42.4 |
| | 10 μm | 88.85 | 2 μm | 2 μm | 42.4 |
| 600 lpi/42.3 μm | 3 μm | 86.18 | 2 μm | 2 μm | 21.2 |
| | 4 μm | 87.13 | 2 μm | 2 μm | 21.2 |
| | 5 μm | 87.71 | 2 μm | 2 μm | 21.2 |
| | 10 μm | 88.85 | 2 μm | 2 μm | 21.2 |
| 1000 lpi/25.2 μm | 3 μm | 86.18 | 2 μm | 2 μm | 12.6 |
| | 4 μm | 87.13 | 2 μm | 2 μm | 12.6 |
| | 5 μm | 87.71 | 2 μm | 2 μm | 12.6 |
| | 10 μm | 88.85 | 2 μm | 2 μm | 12.6 |
| 1200 lpi/21.15 μm | 3 μm | 86.18 | 2 μm | 2 μm | 10.6 |
| | 4 μm | 87.13 | 2 μm | 2 μm | 10.6 |
| | 5 μm | 87.71 | 2 μm | 2 μm | 10.6 |
| | 10 μm | 88.85 | 2 μm | 2 μm | 10.6 |

For an elliptical emitted spot, rotation of the light valve array changes the effective size of the spot in the slow scan direction. In this case, the inclination angle α is selected by simultaneously satisfying equations (3), (4), (5) and (6). The optical magnification in the slow scan direction, given by the line spacing divided by 2S, is then determined for each line spacing with the light valve spot size calculated from equations (4), (5) and (6). Various selected parameters for this embodiment are summarized in Table II. Table II shows that it is possible to position the line scan to at least 0.1 of the line spacing for line densities from 300 to at least 1200 lines/inch.

TABLE II

| Line Density/ Line Spacing | d | α for position control = 0.1 line spacing | 2b (2a = 2 μm) | Effective slow-scan spot size on valve = 25 | Optical mag in slow-scan direction |
|---|---|---|---|---|---|
| 300 lpi/ 84.7 μm | 3 μm | 86.1 | 6 μm | 2.03600 μm | 41.6 |
| | | 83.0 | 25.2 μm | 3.65682 μm | 23.2 |
| | 4 μm | 87.1 | 6 μm | 2.02038 μm | 41.9 |
| | | 85.7 | 30 μm | 3.00618 μm | 28.2 |
| | 5 μm | 87.7 | 6 μm | 2.01284 μm | 42.1 |
| | | 87.1 | 30 μm | 2.50680 μm | 33.8 |
| | 10 μm | 88.85 | 6 μm | 2.00322 μm | 42.3 |
| 600 lpi/ | 3 μm | 86.1 | 6 μm | 2.03600 μm | 20.8 |

TABLE II-continued

| Line Density/ Line Spacing | d | α for position control = 0.1 line spacing | 2b (2a = 2 μm) | Effective slow-scan spot size on valve = 25 | Optical mag in slow-scan direction |
|---|---|---|---|---|---|
| 42.3 μm | | 84.9 | 20 μm | 2.67006 μm | 15.8 |
| | 4 μm | 87.1 | 6 μm | 2.02038 μm | 20.9 |
| | | 85.7 | 30 μm | 3.00618 μm | 14.1 |
| | 5 μm | 87.7 | 6 μm | 2.01284 μm | 21.0 |
| | | 87.1 | 30 μm | 2.50680 μm | 16.9 |
| | 10 μm | 88.85 | 6 μm | 2.00322 μm | 21.1 |
| 1000 lpi/ 25.2 μm | 3 μm | 86.1 | 6 μm | 2.03600 μm | 12.4 |
| | | 84.9 | 20 μm | 2.67006 μm | 9.4 |
| | | 83.0 | 25.2 μm | 3.65682 μm | 6.9 |
| | 4 μm | 87.1 | 6 μm | 2.02038 μm | 12.5 |
| | | 86.7 | 20 μm | 2.30482 μm | 10.9 |
| | | 85.7 | 30 μm | 3.00618 μm | 8.4 |
| | 5 μm | 87.7 | 6 μm | 2.01284 μm | 12.5 |
| | | 87.1 | 30 μm | 2.50680 μm | 10.1 |
| | 10 μm | 88.85 | 6 μm | 2.00322 μm | 12.6 |
| 1200 lpi/ 21.15 μm | 3 μm | 86.1 | 6 μm | 2.03600 μm | 10.4 |
| | | 84.9 | 20 μm | 2.67006 μm | 7.9 |
| | | 83.0 | 25.2 μm | 3.65682 μm | 5.8 |
| | 4 μm | 87.1 | 6 μm | 2.02038 μm | 10.5 |
| | | 85.7 | 30 μm | 3.00618 μm | 7.0 |
| | 5 μm | 87.7 | 6 μm | 2.01284 μm | 10.5 |
| | | 87.1 | 30 μm | 2.50680 μm | 8.4 |
| | 10 μm | 88.85 | 6 μm | 2.00322 μm | 10.6 |

A special case of the present invention occurs when the ratio of the light valve spacing d to the spot size 2b is equal to the fractional accuracy K. For this condition, equation (3) is satisfied for α=0 and no inclination of the array is required. To achieve this condition with a waveguided light valve array, the width of each emitted spot is enlarged using the array structure 180, shown in FIG. 9, wherein the output light beam is emitted through narrow output waveguides 182*a* and 182*b*, which are transparent to the light generated in active regions 184*a* and 184*b*. The width of output waveguides 182*a*, 182*b*, etc. is less than the critical width required for complete confinement of the transmitted light. Consequently, by decreasing the width of each output waveguide, the transmitted beam of each light valve is widened independently of the element-to-element spacing in the array to a value which is 1/K times the element-to-element spacing. Output waveguides of this type may be of the type shown in U.S. Pat. No. 4,802,182 which is incorporated herein by reference. Combinations of light valve spot size, valve-to-valve spacing, and optical magnification suitable for this embodiment of a high resolution printing system are given in Table III for a positioning accuracy of 0.1

TABLE III

| Line Resolution/ Raster Spacing | d | α for position control = 0.1 line spacing | 2b (2a = 2 μm) | Effective slow-scan spot size on valve = 25 | Optical mag in slow-scan direction |
|---|---|---|---|---|---|
| 300 lpi/84.7 μm | 3 μm | 0 | 30 μm | 30 μm | 2.8 |
| 600 lpi/42.3 μm | 3 μm | 0 | 30 μm | 30 μm | 1.4 |
| 1000 lpi/25.2 μm | 2 μm | 0 | 20 μm | 20 μm | 1.26 |
| 1200 lpi/21.15 μm | 2 μm | 0 | 20 μm | 20 μm | 1.06 |

Described above are embodiments employing two distinct methods of controlling the formation of the imaged spot on the photoreceptor, namely enlargement of the slow-scan spot size using the f-number of the post-polygon optics, and simultaneous magnification of the effective slow-scan spot size and the effective light valve-to-light valve spacing. Other enlargement schemes may also be employed without departing from the spirit and scope of the present invention.

Figure 10:
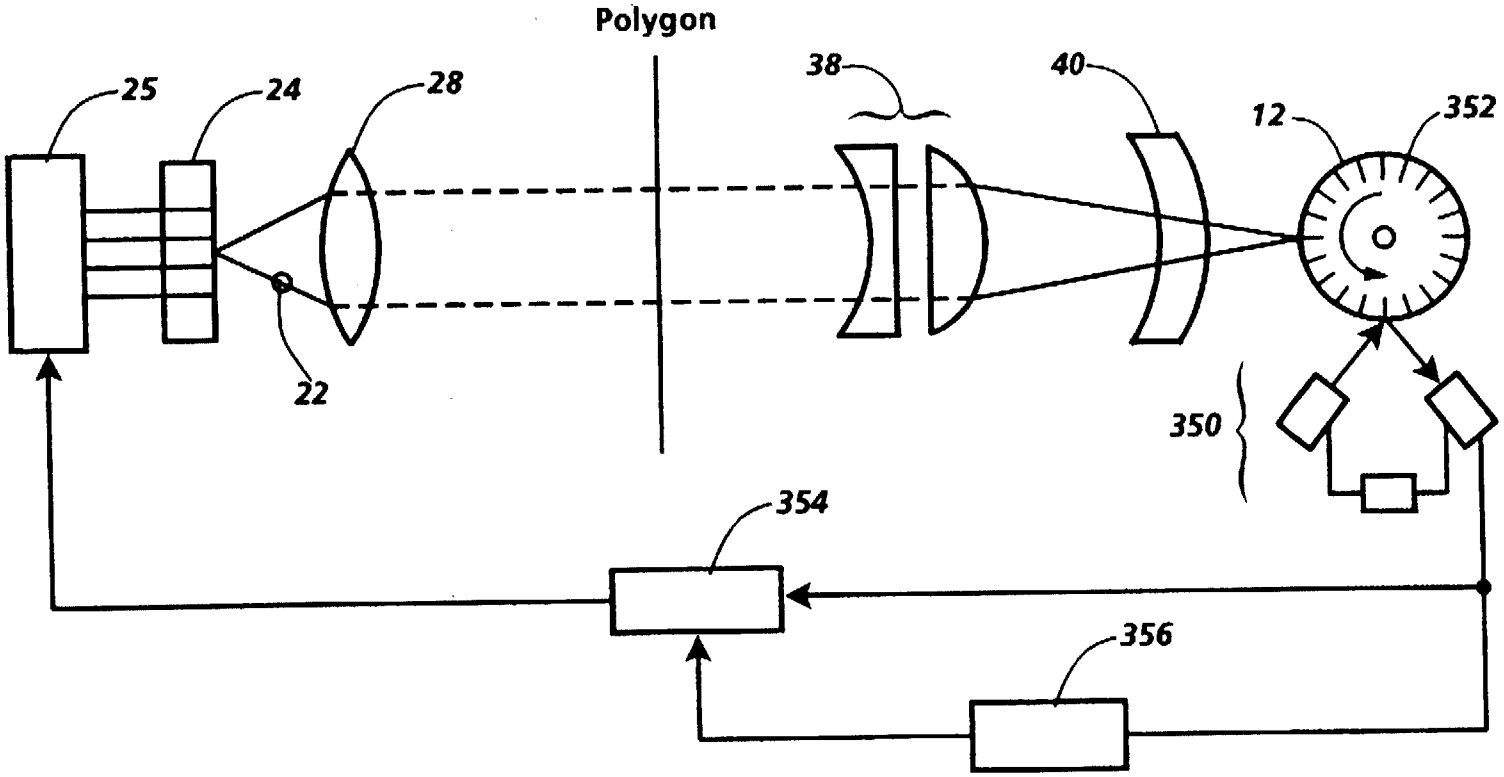
FIG. 10 shows a simplified side view of the optical configuration of an apparatus having means for detecting errors in the position of a photoreceptive drum, and for using the detected error to adjust the position of the spot on the drum.

To correct for spot position errors, the present invention may use feedback control, control from stored data, or both. When using feedback control, known methods and devices might determine the error between the actual spot position and the desired spot position, and create the proper control signals for selecting the proper light valve to minimize the error. For example, FIG. 10 shows one method for determining the rotational error of a photoreceptor 12 by the use of a synchronized strobe and sensor arrangement 350 and timing marks 352 on the photoreceptor 12. The arrangement 350 includes signal processing which enables a determination of the existence and extent of any rotational error, and a control signal generator which responds to the error. The control signal is transmitted to a control apparatus and/or decision circuit 354, which, in turn, controls the switching unit 25. The switching unit 25 controls the light valve array 24 such that the proper light valve passes light.

As previously mentioned, stored data may also be used to control the spot position. Such a method is useful for correcting recurrent errors such as known, off axis rotations of a drum or known surface distortions. Referring now once again to FIG. 10, a stored correction is applied to the apparatus 354 by a processor controlled memory 356. The output of the memory 356 may be synchronized with rotation information by the strobe and sensor apparatus 350. As is obvious, the use of stored data may or may not be used in conjunction with feedback control.

Figure 11:
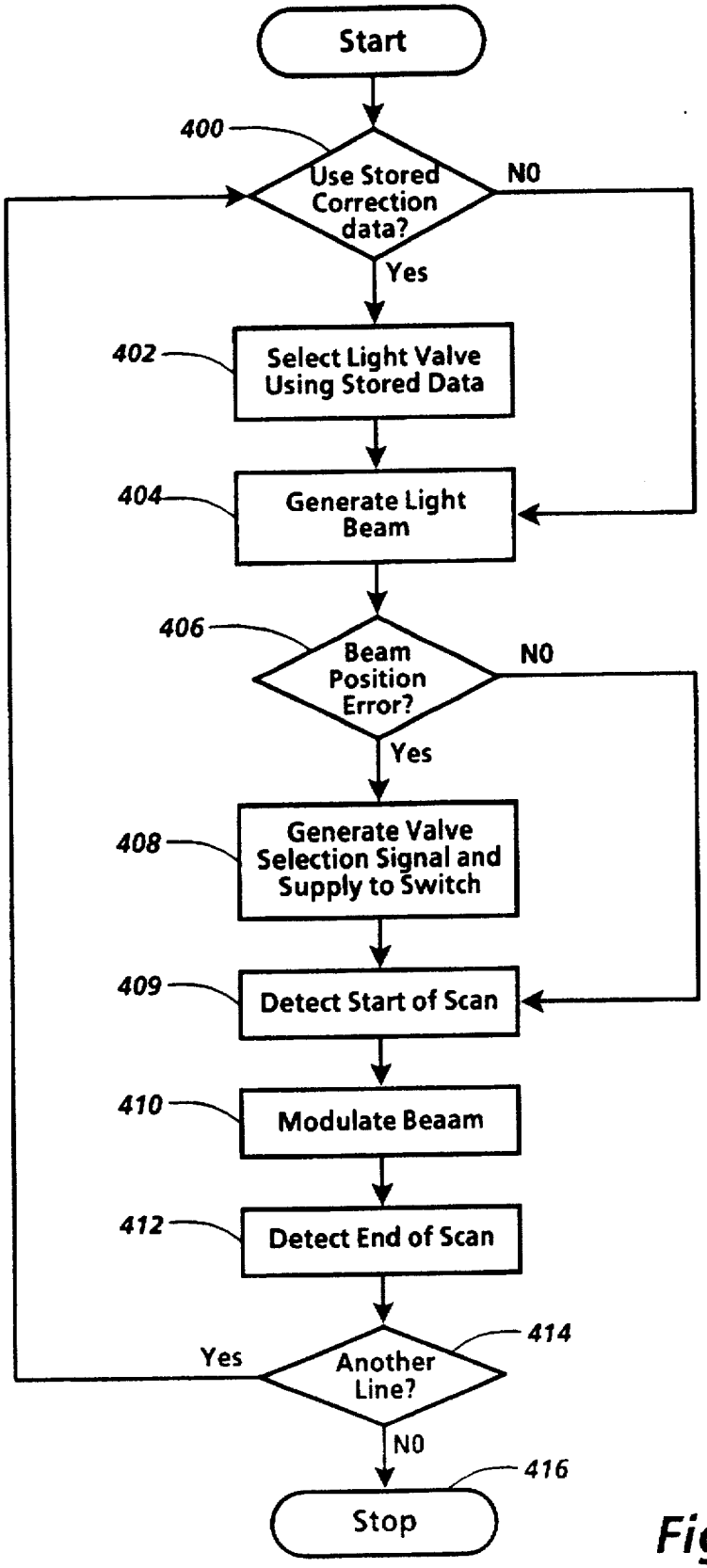
FIG. 11 is a flow diagram of a system for determining and correcting slow scan direction position errors on the fly, and for compensating for predetermined slow scan direction spot position errors.

FIG. 11 shows a flow diagram of a complete cycle of operation for correcting slow scan direction errors. It is assumed that any predetermined correction information has been stored in memory. To begin, a determination is made as to whether the current scan line is to be corrected using predetermined correction information, step 400. If so, the stored data is used to select the light valve (by applying the appropriate bias to the light valves) which causes the predetermined correction to be made, step 402.

After step 402, or after step 400 if stored correction information is not used, a light beam is generated and applied to the light valve array, step 404. Next, the slow scan position of the beam from the light valve array in the image plane is found, that position is compared to the desired position, and determinations are made as to the existence and the extent of any slow scan direction beam position error, step 406. If there is a slow scan direction position error, that error is used to generate an appropriate selection signal which causes the proper light valve to be selected to correct for the error, step 408.

After step 408, or after step 406 if it was determined that no slow scan direction error existed, the light beam from the light valve is used to detect the start of a scan line, step 409. Step 409 is performed at this time since it is important that the start of a scan line be synchronized with light beam modulation. Otherwise, in systems having the light valve array aligned at an angle with the fast scan direction, light intensity modulation may not occur in proper synch with the spot in the image plane.

After the detection of the start of a scan line, the intensity of the spot in the image plane is modulated according to the scan line information, step 410. Then, the end of the scan line is detected, step 412. A determination is then made as to whether another scan line is to be written, step 414. If so, the process described above returns to step 400. Otherwise, the process ends, step 416.

By incorporating the above described spot position control methodology and appropriate apparatus with the appropriate apparatus for xerographic printing, such as a photoreceptor belt or drum, some means for moving the photoreceptor, some means for charging the photoreceptor, some means for forming a latent image on the photoreceptor, some means for transferring the latent image to paper, some means for erasing the latent image from the photoreceptor and for cleaning the photoreceptor, a paper transport means, and some means for fusing the image onto the paper, a complete xerographic print engine may be produced. While details of the structure and operation of such a printer is beyond the scope of the present disclosure, such details are well known in the art.

Further, those skilled in the art to which this invention relates will know of many changes in construction and of differing embodiments and applications of the present invention. Thus, the disclosures and descriptions herein are illustrative and are not intended to be limiting.

What is claimed is:

1. An apparatus for providing light spot position control for scanning a light spot across an image plane in a fast scan direction to form a scan line on the image plane, wherein the image plane is movable in a slow scan direction orthogonal to the fast scan direction so as to form successive scan lines separated by an inter-scan line distance, comprising:

a light source, for emitting a beam of light;

a linear array of independently addressable, single light valve elements including first and last light valve elements, positioned to intercept the beam of light, wherein each of the light valve elements of said array is capable of passing a portion of the illumination from the beam of light and forming a light spot, having a continuous illumination profile, on the image plane, and wherein said first and last light valve elements are spaced from one another by a distance which will cause the light spot formed by each of said first and last light valve elements to be separated from one another by said inter-scan line distance;

a controller in communication with said array of light valve elements, for allowing only a selected single light valve element to pass illumination and form a light spot on the image plane;

a scanner for scanning the light spot across the image plane in the fast scan direction to form a scan line, said scanner including a lens for focusing the light spot on the image plane; and a position detector, in communication with said controller, for detecting a position of the light spot on the image plane in the slow scan direction, and generating a control signal as a function thereof, said controller being responsive to said control signal, for selectively activating a single one of the light valve elements of said array to form a next successive scan line on the image plane.

2. The apparatus of claim 1, wherein the linear array of independently addressable light valve elements includes a monolithic active semiconductor waveguide containing a p-n junction.

3. The apparatus of claim 1, wherein the linear array of independently addressable light valve elements includes aliquid crystal device.

4. The apparatus of claim 1, wherein the linear array of independently addressable light valve elements includes a total internal reflection modulator.

5. The apparatus according to claim 1, wherein a full width at half maximum of an intensity profile of the light spot formed on the image plane is equal to the inter-scan line distance.

6. The apparatus according to claim 1, wherein the image plane comprises a photoreceptor.

7. The apparatus according to claim 1, wherein the linear array of light valve elements is oriented transversely to the slow scan direction.

8. A printer in which a light spot is scanned across a photoreceptor to form an image thereon in response to image data, and wherein the position of the light spot is controlled for scanning in a fast scan direction to form a scan line on the photoreceptor, wherein the photoreceptor is movable in a slow scan direction orthogonal to the fast scan direction so as to form successive scan lines separated by an inter-scan line distance, comprising a light source, for emitting a beam of light;

a linear array of independently addressable, single light valve elements including first and last light valve elements, positioned to intercept the beam of light, wherein each of the light valve elements of said array is capable of passing a portion of the illumination from the beam of light and forming a light spot, having a continuous illumination profile, on the photoreceptor, and wherein said first and last light valve elements are spaced from one another by a distance which will cause the light spot formed by each of said first and last light valve elements to be separated from one another by said inter-scan line distance;

a controller in communication with said array of light valve elements, for allowing only a selected single light valve element to pass illumination and form a light spot on the photoreceptor;

a scanner for scanning the light spot across the photoreceptor in the fast scan direction to form a scan line, said scanner including a lens for focusing the light spot on the photoreceptor; and a position detector, in communication with said controller, for detecting a position of the photoreceptor in the slow scan direction, and generating a control signal as a function thereof, said controller being responsive to said control signal, for selectively activating a single one of a light valve elements of said array to form the next successive scan line on the photoreceptor.

9. The laser printer of claim 8, wherein the array of independently addressable light valve elements includes a monolithic active semiconductor waveguide containing a p-n junction.

10. The laser printer of claim 8, wherein the array of independently addressable light valve elements includes a liquid crystal device.

11. The position controlling apparatus of claim 8, wherein the array of independently addressable light valve elements includes a total internal reflection modulator.

12. The printer according to claim 8, further including a modulator connected to the light source for varying the illumination incident on the linear array of light valve elements in accordance with the image data, so as to control the portion of the illumination transmitted by each light valve element.

13. A printer according to claim 8, further including a modulator connected to the linear array of light valve elements for alternatively blocking and transmitting the beam of light incident on the selectively activated light valve element in accordance with the image data.

* * * * *